US007516499B2

(12) United States Patent
Gardner, III

(10) Patent No.: US 7,516,499 B2
(45) Date of Patent: Apr. 14, 2009

(54) GARMENT HAVING AN ADJUSTABLE WAIST

(75) Inventor: James H. Gardner, III, Ambler, PA (US)

(73) Assignee: Destination Maternity Corporation, Philadelphia, PA (US)

( * ) Notice: Subject to any disclaimer, the term of this patent is extended or adjusted under 35 U.S.C. 154(b) by 170 days.

(21) Appl. No.: 11/548,387

(22) Filed: Oct. 11, 2006

(65) Prior Publication Data

US 2008/0086794 A1 Apr. 17, 2008

(51) Int. Cl.
*A41D 1/20* (2006.01)
*A41D 1/06* (2006.01)
*A41D 1/14* (2006.01)

(52) U.S. Cl. ..... 2/221; 2/237

(58) Field of Classification Search ..... 2/237, 2/221, 220, 219, 234, 235, 236, 215, 76, 2/218, 211, 213, 227, 214, 401
See application file for complete search history.

(56) References Cited

U.S. PATENT DOCUMENTS

| | | | | | |
|---|---|---|---|---|---|
| RE9,038 | E | * | 1/1880 | Spies | 2/237 |
| 280,444 | A | * | 7/1883 | Bush | 2/237 |
| 362,565 | A | * | 5/1887 | Yarwood | 2/400 |
| 464,826 | A | * | 12/1891 | Kuhn | 2/237 |
| 1,709,508 | A | * | 4/1929 | Weiner et al. | 2/237 |
| 1,832,687 | A | * | 11/1931 | Boshnack | 2/234 |
| 2,206,505 | A | * | 7/1940 | Klein | 2/237 |
| 2,585,175 | A | * | 2/1952 | Rosenberg | 2/234 |
| 3,110,903 | A | * | 11/1963 | Burchard | 2/221 |
| 4,364,124 | A | * | 12/1982 | Barna | 2/234 |
| 4,803,740 | A | * | 2/1989 | Dawson | 2/215 |
| 4,893,358 | A | | 1/1990 | Bice, Jr. | |
| 5,283,910 | A | | 2/1994 | Flint | |
| 5,946,730 | A | | 9/1999 | Blair | |
| 6,292,950 | B1 | | 9/2001 | Mentone | |
| 6,311,333 | B1 | | 11/2001 | Batra | |
| 6,367,086 | B1 | * | 4/2002 | Woodard | 2/237 |
| 6,839,913 | B2 | | 1/2005 | Villalobos | |
| 2004/0210987 | A1 | | 10/2004 | Carney | |
| 2006/0010571 | A1 | | 1/2006 | Oakley | |
| 2007/0028364 | A1 | * | 2/2007 | Oomae | 2/237 |

OTHER PUBLICATIONS

International Search Report and Written Opinion dated Jul. 9, 2008, in PCT/US07/80813.

* cited by examiner

*Primary Examiner*—Amy B Vanatta
(74) *Attorney, Agent, or Firm*—Duane Morris LLP

(57) ABSTRACT

A garment with an adjustable waist is disclosed, having an opening intersecting a waist section of the garment, a closure mechanism urging the opening to a narrowed position or a widened position to adjust the girth of the waist section, and a panel bridging across the opening, the panel being hidden by the opening in a narrowed position. An embodiment of the closure mechanism includes a slide fastener extending along the opening. Another embodiment of the closure mechanism includes a waist band for extension across the opening and for selective attachment to respective fasteners located along the waist section to correspond with adjustments in the girth of the waist section.

20 Claims, 4 Drawing Sheets

GARMENT HAVING AN ADJUSTABLE WAIST

FIELD OF THE INVENTION

The present invention relates to a garment in which the waist is adjustable in girth.

BACKGROUND OF THE INVENTION

A garment for wearing around a person's waist is constructed from multiple pieces of a garment fabric. The pieces are joined together along seams of the garment, for example, side seams, a front seam and a rear seam, all of which intersect a waist section of the garment. Usually, each seam at the waist section is closed by sewing together the pieces of the garment fabric. Accordingly, the closed seams at the waist section provide the waist section with a fixed girth. It would be advantageous for a garment to have a waist section that can be expanded or contracted for fitting different waist sizes, for example, a person whose waist size changes, or for adapting the waist section to fit persons having different waist sizes. Further, it would be advantageous for a garment to have a waist section that can progressively expand for accommodating waist size changes that occur throughout different stages of pregnancy, and that can progressively contract for accommodating waist size changes subsequent to giving birth, and during a time period during which reductions in body weight occur.

U.S. Pat. No. 5,283,910 discloses a garment with an elastic band that extends through a tubular casing at the waist section of the garment. A free end of the elastic band is selectively attachable to respective fasteners that are spaced apart along the waist section of the garment.

U.S. Pat. No. 5,946,730 discloses a V-shaped, insert panel to cover an opening that is present upon unbuttoning a button-fly of a jeans garment.

U.S. Pat. No. 4,893,358 discloses a garment having a gathered waist section that is held in a gathered position by miniature hook and loop fasteners.

SUMMARY OF THE INVENTION

According to an embodiment of the invention, a garment having an adjustable waist has an opening intersecting a waist section of the garment, a panel bridging across the opening, and a closure mechanism, the opening being narrowed and held by operation of the closure mechanism to narrow the opening, and the opening being widened and held by operation of the closure mechanism, thereby to adjust the girth of the waist section. Further, the panel is behind the closure mechanism.

According to a further embodiment of the invention, the opening extends between two pieces of fabric, and the panel is hidden behind the two pieces of fabric when the opening is narrowed by operation of the closure mechanism.

According to a further embodiment of the invention, the two pieces of fabric are joined together along a side seam of the garment.

DETAILED DESCRIPTION OF THE INVENTION

Figure 1:
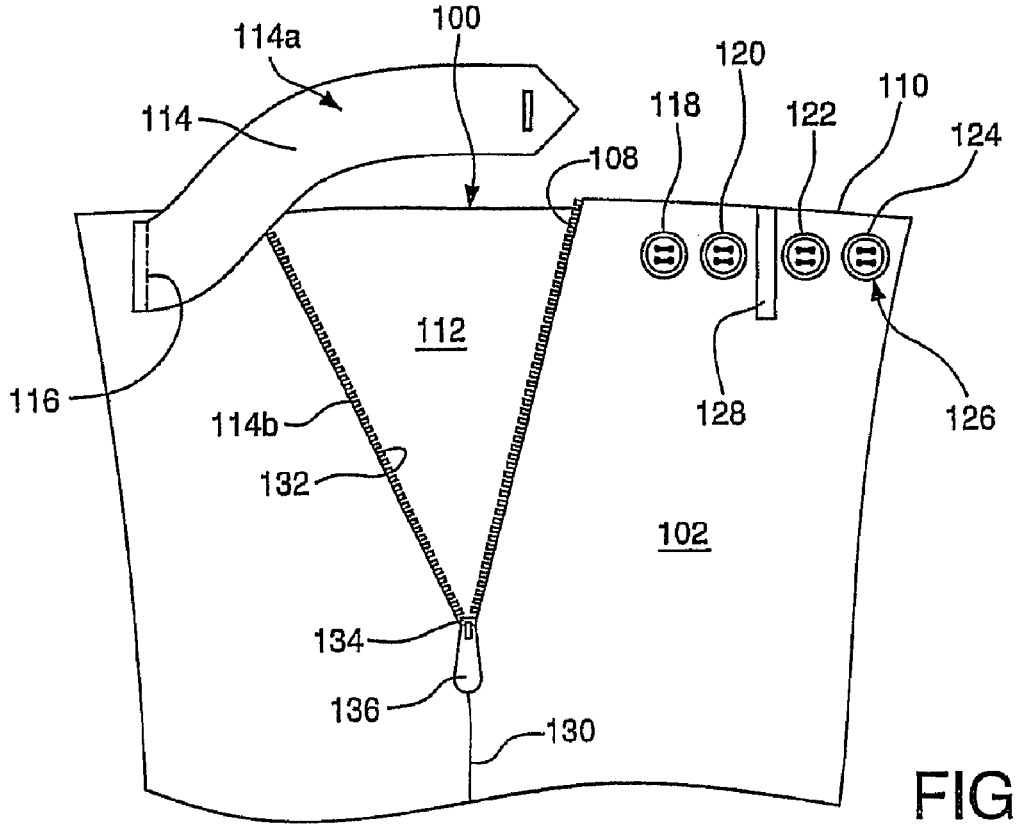
FIG. 1 is a fragmentary view of a garment having an adjustable waist section intersected by an opening, a pane covering the opening, and a closure mechanism for holding the opening in a narrowed position or a widened position, thereby to adjust the girth of the waist section.
Figure 2:
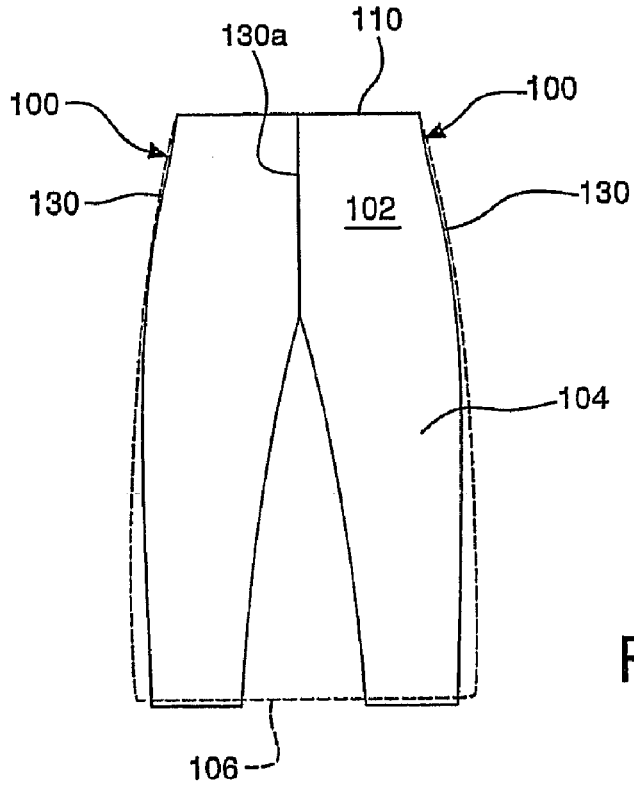
FIG. 2 is a front view of a garment having the alternative forms of either trousers or a skirt.

FIG. 1 discloses an expandable section 100 of a garment 102. FIG. 2 discloses the garment 102 as having the alternative forms of either a pair of trousers 104, or a skirt 106 indicated by phantom outline. FIG. 1 further discloses a generally V-shaped opening 108 in the garment 102, which intersects a waist section 110 of the garment 102. When the opening 108 is widened to a laterally widened position, as disclosed by FIG. 1, the waist section 110 of the garment 102 is expanded in girth. Further, as will be described hereinafter, when the opening 108 is narrowed to a laterally narrowed position, the waist section 110 is contracted in girth. Thereby, the waist section 110 is expandable and contractible to change the waist size of the garment 102.

FIG. 1 further discloses a feature of a V-shaped panel 112 that bridges across the opening 108 to cover the opening 108. The narrow end of the V-shaped panel 112 is truncated. The panel 112 comprises a flexible material, including, but not limited to: a fabric identical to that of the garment 102, a stretchable material, and a thin film of polymeric material or a mesh. An exemplary stretchable material comprises a fabric woven with yarns of elastane fibers conducive to elastic stretching, for example, Lycra® or Spandex® elastane fibers. According to various embodiments of the invention, each of the garment 102 and the panel 112 is made of either a non-stretchable material or a stretchable material, according to the extent of stretching desired at the waist section 110.

FIG. 1 further discloses a closure mechanism 114. An embodiment of the closure mechanism comprises a waist band 114*a*. The waist band 114*a* comprises a belt that is sewn at one end 116 to the waist section 110 of the garment 102. The waist band 114*a* is made with any desirable, flexible material suitable for use as a belt, including, but not limited to: fabric identical to that of the garment 102, leather, or synthetic film material. Further, the closure mechanism 114 comprises one or more respective fasteners 118, 120, 122, 124, for example, a series of spaced apart buttons 118, 120, 122, 124 which are sewn or otherwise attached along the waist section 110. The respective fasteners 118, 120, 122, 124 comprise alternative embodiments, including, but not limited to: snap fasteners, arrays of miniature sized hooks and loops fasteners as, for example, Velcro®, a hook and loop type fastener and a clasp type fastener. A free end of the waist band 114*a* has an attachable fastener 126, for example, in the form of a button hole, such that the button hole is selectively attachable to the respective fasteners 118, 120, 122, 124, wherein the respective fasteners 118, 120, 122, 124 are positioned at respective locations along the waist section 110 of the garment 102 to correspond with adjustments in the girth of the waist section 110. A belt loop 128 is provided for inserting the waist band 114*a* through the belt loop 130.

Figure 3:
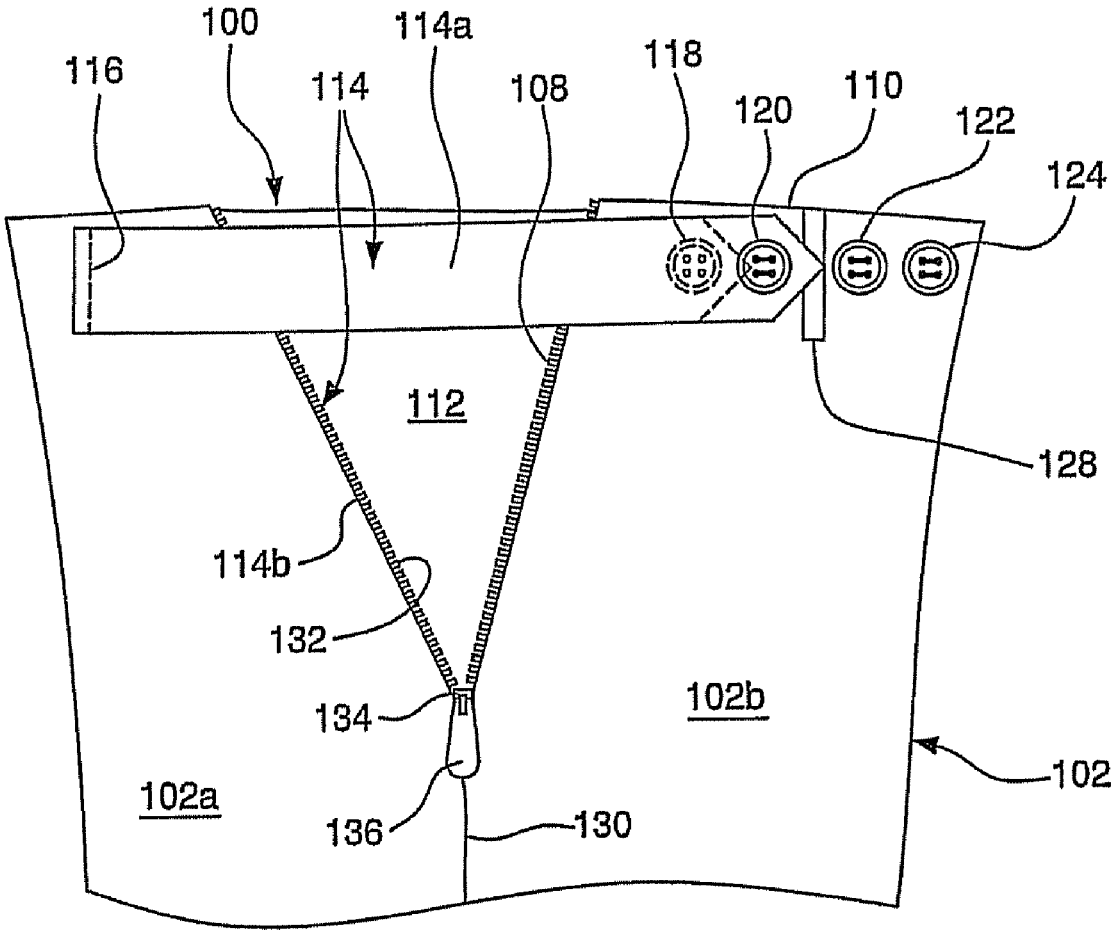
FIG. 3 is a view similar to FIG. 1, and further discloses the closure mechanism comprising a waist band holding the opening in a widened position.

FIG. 3 discloses that the waist band 114*a* is extendable over the opening 108, and is extendable along the waist section 110 of the garment 102 to form a partial belt. The waist band 114*a* is selectively attached to the respective fastener 120 to hold the opening 108 in a widened position, which stabilizes the girth of the waist section 110. The waist band 114*a* extends across, and covers another respective fastener 118 shown with phantom outline in FIG. 3. According to an alternative embodiment of the invention, the waist band 114*a* can be moved from its position disclosed by FIG. 3, to become attached to the respective fastener 118, which allows further widening of the opening 108, so as to become wider than that shown in FIG. 3, and so as to expand the girth of the waist section 110. Such further widening of the opening 108 is accompanied by elastic stretching of the stretchable garment materials, for example, when either or both the panel 112 and the garment 102 comprise stretchable materials. Once again, the closure mechanism 114 comprising the waist band 114*a* holds the opening 108 in a widened position, which stabilizes the girth of the waist section 110.

FIG. 3 further discloses that the opening 108 is positioned at or along a generally vertical seam 130 of the garment 102, wherein two pieces of fabric 102*a*, 102*b* are sewn together to close the seam 130, except where the opening 108 is positioned at the seam 130. Alternatively, the opening 108 can be positioned elsewhere in the garment 102, for example, by cutting a slit through the garment 102.

FIG. 2 discloses that the garment 102 is fabricated with two vertical side seams 130, and a vertical front seam 130*a*. According to a further embodiment of the invention, each side seam 130 of the garment has a corresponding opening 108 positioned at or along the side seam 130. Each opening 108 positioned at or along a corresponding side seam is disguised, as having the appearance of a side-pocket that a person associates with being along the side seam 130 of a garment 102. According to an alternative embodiment of the invention, an opening 108 is positioned at any one of the seams 130, 130*a*.

FIGS. 1 and 3 disclose an embodiment of the invention, according to which the closure mechanism 114 comprises a fastener 114*b*, for example, a slide fastener including a zipper. Alternative embodiments of the fastener 114*b* include, but are not limited to: snap fasteners, arrays of miniature sized hooks and loops fasteners as, for example, Velcro®, larger size hook and loop type fasteners and a series of clasp type fasteners. Embodiments of the closure mechanism 114 comprise the fastener 114*b* alone, or the waist band 114*a* alone, or both the fastener 114*b* and the waist band 114*a*. The fastener 114*b* will now be described as an embodiment of a slide fastener 114*b*. The embodiment of a slide fastener 114*b* comprises two interlocking tracks 132 and a slide mechanism 134. The slide mechanism 134 is operated by being slidable along the tracks 132 in a first direction to interlock the tracks 132 and close the slide fastener 114*b*, and the slide mechanism 134 is operated by being slidable in a reverse direction to separate the tracks 132 and open the slide fastener 114*b*. The slide mechanism 134 has a small handle 136 attached by a swivel fastener. The handle 136 is manually gripped between a person's thumb and finger, for example, to operate the slide mechanism 134.

FIGS. 1 and 3 disclose the two interlocking tracks 132 extending along opposite sides of the V-shaped opening 108, such that the opening 108 is urged to a widened position by said described operation of the slide mechanism 134 to open the slide mechanism 134. The slide mechanism 134 of the slide fastener 114*b* has been moved to the position shown in FIGS. 1 and 3. Further, the opening 108 is held in a widened position by the slide fastener 114*b* of the closure mechanism 114 being in an open position, which stabilizes the girth of the waist section 110. The panel 112 is behind the closure mechanism 114.

Figure 4:
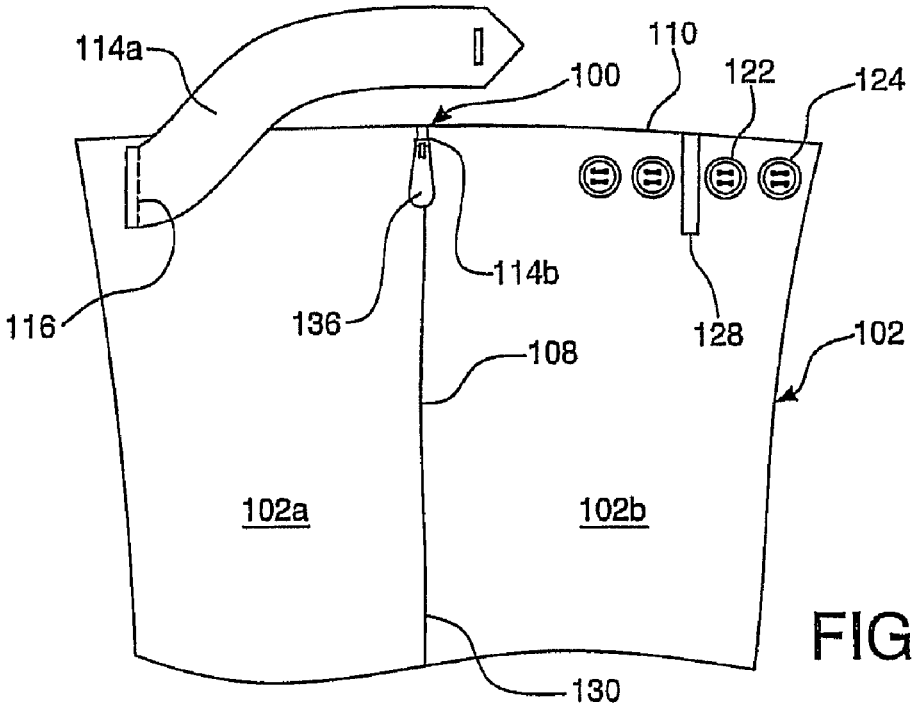
FIG. 4 is a view similar to FIG. 1, and further discloses the closure mechanism comprising a slide fastener holding the opening in a narrowed position, and further holding the opening in a closed position.
Figure 5:
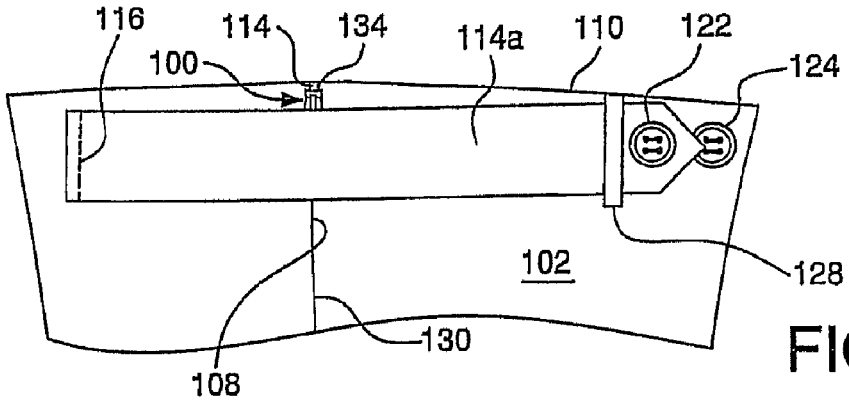
FIG. 5 is a view similar to FIG. 4, and further discloses the closure mechanism comprising a waist band holding the opening in a narrowed position.
Figure 6:
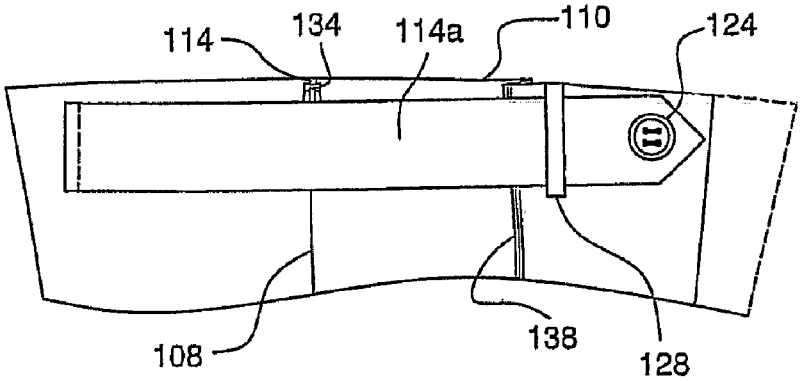
FIG. 6 is a view similar to FIG. 5, and further discloses the closure mechanism comprising a waist band holding the waist section of the garment in a gathered position.

Each of FIGS. 4, 5 and 6 discloses the opening 108 that has been urged to a narrowed position by operation of the closure mechanism 114, wherein the slide mechanism 134 has been moved to a closed position. Further, the closure mechanism 114 comprising the slide fastener 114*b* holds the opening 108 in the narrowed position, which stabilizes the girth of the waist section 110. In addition, the closure mechanism 114 closes the opening 108. The panel 112 is behind the closure mechanism 114. When the opening 108 is narrowed, the panel 112 is sufficiently limp, flexible and thin, so as to become gathered or folded inside the garment 102, without causing discomfort to a person wearing the garment 102.

FIG. 5 discloses the waist band 114*a* selectively attached to the fastener 122. The closure mechanism 114 that comprises the waist band 114*a* and the multiple fasteners 118, 120, 122, 124, has the free end of the waist band 114*a* selectively attached to the respective fastener 122, to hold the opening 108 in the narrowed position, as shown in FIG. 5. The waist band 114*a* extends through the belt loop 128, and covers the handle 136 on the slide mechanism 134 that has been operated to move to a closed position. The closure mechanism 114*b* can be held closed, as disclosed by FIGS. 4, 5 and 6, or alternatively, held open, as disclosed by FIG. 3, because the waist band 114*a* holds the opening 108 in either the narrowed position, as shown in FIGS. 4, 5 and 6, or one of the widened positions, as shown in FIG. 3. Alternatively, the closure mechanism 114*b* can be absent, and the opening 108 would be held closed solely by the waist band 114*a*.

FIG. 6 discloses that the waist band 114*a* can be moved from its position shown in FIG. 5, to become selectively attached to the fastener 124. The garment 102 can be gathered, as shown at 138, which further contracts the girth of the waist section 110. The waist band 114*a* stabilizes the girth of the waist section.

Figure 7:
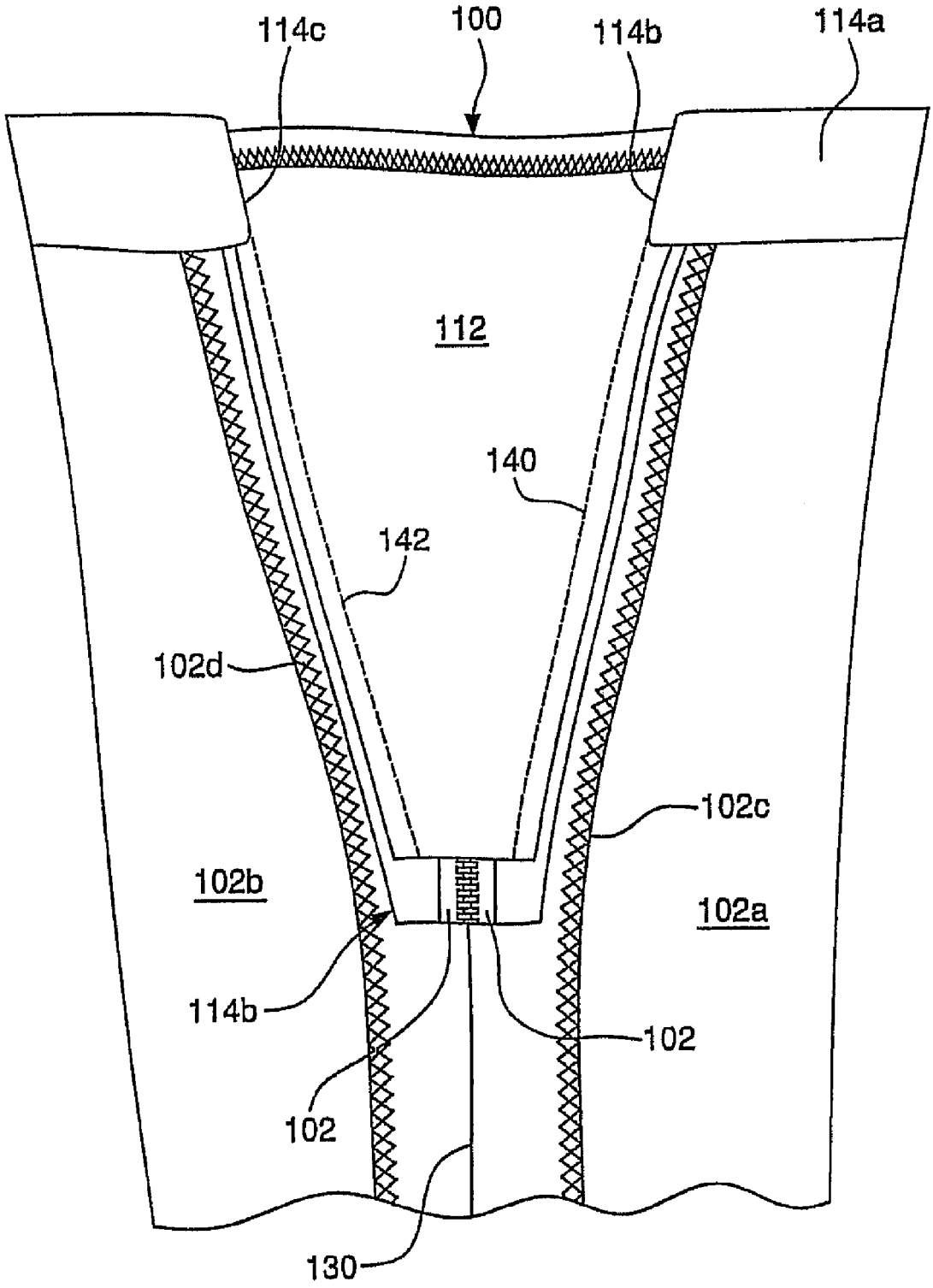
FIG. 7 is a view of the inside of the garment that is disclosed by FIG. 1.

FIG. 7 discloses a sewn construction of the expandable section 100 of the garment 102. The two pieces of fabric 102*a*, 102*b* are sewn together along the seam, except for the V-shaped opening 108. The two pieces of fabric 102*a*, 102*b* are doubled back on themselves, so as to define there between the edges of the V-shaped opening 108. Further, the edges 102*c*, 102*d* of the two pieces of fabric 102*a*, 102*b* are shown as being bound at the edges with surger machine stitching. The slide fastener 114*b* is opened to a V-shape, and is laid over the doubled back edges 102*c*, 102*d*. Then, the V-shaped panel 112 is laid over the open, V-shaped, slide fastener 114*b*. The overlaid, V-shaped slide fastener 114*b* and V-shaped panel 112 are sewn together, as shown by stitches 140, 142, to the edges 102*c*, 102*d* of the two pieces of fabric 102*a*, 102*b*. According to an embodiment of the invention, the fastener 114*b* is visible along the doubled back edges 102*c*, 102*d* of the two pieces of fabric 102*a*, 102*b*, while viewing the exterior of the garment, as shown in FIGS. 1 and 3. In an alternative embodiment of the invention, the fastener 114*b* is invisible or hidden behind the doubled back edges 102*c*, 102*d* of the two pieces of fabric 102*a*, 102*b*, as shown in FIG. 4. In another embodiment of the invention, the fastener 114*b* is absent from the garment, such that the doubled back edges 102*c*, 102*d* provide finished hem lines that remain unheld by a fastener for a more casual dress-code appearance. Further, an internal waist band 114*a* of the garment 102 is tucked under 114*c*, 114*d* at the V-shaped opening 108, and is sewn by the stitches 140, 142. Thus, the panel 112 is permanently attached to the garment 102. When the garment 102 comprises a material such as denim, the fastener 114*b* of the closure mechanism 114 comprises a lapped zipper.

Each of the exemplary embodiments of the garment 102, described herein, advantageously has a waist section that can progressively expand with different waist size adjustments for accommodating waist size changes that occur throughout different stages of pregnancy, and that can progressively contract with different waist size adjustments for accommodating waist size changes subsequent to giving birth, and during a time period during which reductions in body weight occur.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A garment having an adjustable waist, comprising:

an opening intersecting a waist section of the garment;

the opening being in a narrowed position or a widened position to adjust the girth of the waist section and accommodate waist size changes;

a flexible panel bridging across the opening and sewn to fabric on first and second edges of the opening, wherein the panel gathers or folds when the opening is in a narrowed position; and a closure mechanism holding the opening in either of said positions and stabilizing the girth of the waist section, wherein the closure mechanism comprises fasteners positioned at the first of the edges of the opening at respective locations along the waist section to correspond with adjustments in the widened position of the girth of the waist section, a waist band positioned at the second of the edges of the opening and extendable over the opening and along the waist section of the garment to form a partial belt, and a free end of the waist band being selectively attachable to the respective fasteners on said first of the edges of the opening.

2. The garment as in claim 1, wherein the opening extends at a vertical side seam in the garment to appear as a pocket at the seam of the garment.

3. The garment as in claim 1, wherein the panel comprises a flexible material, including a fabric identical to that of the garment, a stretchable material, a thin film of polymeric material or a mesh.

4. The garment as in claim 1, wherein the panel comprises a fabric woven with yarns of elastane fibers conducive to elastic stretching for further widening of the opening to expand the girth of the waist section.

5. The garment as in claim 1, wherein each of the garment and the panel is made of either a non-stretchable material or a stretchable material for stretching desired at the waist section.

6. The garment as in claim 1, wherein the panel is hidden when the opening is held in a narrowed position.

7. The garment as recited in claim 1 wherein the opposite sides of the fabric include doubled back edges of fabric.

8. The garment as recited in claim 1 wherein the opposite sides of the fabric include doubled back edges of fabric providing finished hem lines.

9. A garment having an adjustable waist, comprising:

an opening intersecting a waist section of the garment;

a closure mechanism including a slide fastener extending along the opening;

the opening being urged to a narrowed position by operation of the slide fastener to close the slide fastener, and the opening being urged to an open position by operation of the slide fastener to open the slide fastener, thereby to adjust the girth of the waist section and accommodating waist size changes;

the closure mechanism holding the opening in either of said positions and stabilizing the girth and accommodating waist size changes;

a panel bridging across the opening, the panel being hidden by the opening in a narrowed position, the panel being sewn to fabric on first and second edges of the opening, wherein the panel gathers or folds when the opening is in a narrowed position; and the closure mechanism further comprises fasteners positioned at the first of the edges of the opening at respective locations along the waist section of the garment to correspond with adjustments in the widened position of the girth of the waist section, a waist band positioned at the second of the edges of the opening extendable over the opening and along the waist section of the garment to form a partial belt, and a free end of the waist band being selectively attachable to the respective fasteners on said first of the edges of the opening.

10. The garment as in claim 9, wherein the opening extends at a vertical side seam in the garment to appear as a pocket at the seam of the garment.

11. The garment as in claim 9, wherein the panel comprises a flexible material, including a fabric identical to that of the garment, a stretchable material, a thin film of polymeric material or a mesh.

12. The garment as in claim 9, wherein the panel comprises a fabric woven with yarns of elastane fibers conducive to elastic stretching for further widening of the opening to expand the girth of the waist section.

13. The garment as in claim 9, wherein each of the garment and the panel is made of either a non-stretchable material or a stretchable material for stretching desired at the waist section.

14. The garment as in claim 9, wherein the panel is hidden when the opening is held in a narrowed position.

15. The garment as recited in claim 9 wherein the slide fastener has two interlocking tracks and a slide mechanism moveable along the tracks to interlock the tracks and close the slide fastener, and moveable in reverse along the tracks to separate the tracks and open the slide fastener, said tracks being on opposite sides of the opening, and the closure mechanism holding the opening in either of said positions and stabilizing the girth.

16. The garment as recited in claim 9 wherein the opening extends at a vertical side seam in the garment to appear as a pocket at the seam of the garment, the garment comprises denim material, and the slide fastener comprises a lapped zipper.

17. The garment as recited in claim 9 wherein the garment comprises denim material, and the slide fastener comprises a lapped zipper.

18. The garment as recited in claim 9 wherein the slide fastener is hidden behind edges of the fabric at the first and second edges of the opening.

19. The garment as recited in claim 9 wherein the slide fastener includes interlocking tracks and a slide mechanism having a handle, wherein the slide mechanism is moveable along the tracks to interlock the tracks and close the slide fastener, and the waistband covers the handle.

20. The garment as recited in claim 9 wherein the opposite sides of the fabric include doubled back edges of fabric.

* * * * *